US007419414B2

(12) United States Patent
Wagner

(10) Patent No.: US 7,419,414 B2
(45) Date of Patent: Sep. 2, 2008

(54) PERSONAL FLOTATION DEVICE FOR INFANTS

(75) Inventor: Steven G. Wagner, Waterloo (CA)

(73) Assignee: Salus Marine Wear Inc., Kitchener, Ontario (CA)

( * ) Notice: Subject to any disclaimer, the term of this patent is extended or adjusted under 35 U.S.C. 154(b) by 0 days.

(21) Appl. No.: 11/622,818

(22) Filed: Jan. 12, 2007

(65) Prior Publication Data

US 2008/0146104 A1 Jun. 19, 2008

Related U.S. Application Data

(60) Provisional application No. 60/869,939, filed on Dec. 14, 2006.

(51) Int. Cl.
*B63C 9/08* (2006.01)

(52) U.S. Cl. ..... 441/112; 441/80

(58) Field of Classification Search ..... 441/80, 441/84, 85, 106, 108, 109, 110, 111, 112, 441/113, 114, 115, 116, 117, 118
See application file for complete search history.

(56) References Cited

U.S. PATENT DOCUMENTS

| | | | | | |
|---|---|---|---|---|---|
| 715,938 | A | * | 12/1902 | Armstrong | 441/117 |
| 3,103,674 | A | * | 9/1963 | Ondrush et al. | 441/118 |
| 5,030,153 | A | * | 7/1991 | Bailey | 441/115 |
| 5,766,114 | A | * | 6/1998 | Campbell | 441/112 |
| 5,775,967 | A | * | 7/1998 | Lacoursiere et al. | 441/115 |
| 5,855,497 | A | | 1/1999 | French | |
| 6,582,266 | B1 | | 6/2003 | Steger et al. | |

* cited by examiner

*Primary Examiner*—Lars A Olson
(74) *Attorney, Agent, or Firm*—Shin Hung; Borden Ladner Gervais LLP

(57) ABSTRACT

An infant personal flotation device (PFD) that comprises a torso float, a head float and a harness. The torso float is wider at the leg region than at the neck region and includes a non-conforming and planar buoyant material. The torso float is wider than the torso of an infant, such that an infant falling in water will automatically assume a supinating position regardless of the position the infant had when he entered the water.

23 Claims, 8 Drawing Sheets

PERSONAL FLOTATION DEVICE FOR INFANTS

CROSS-REFERENCE TO RELATED APPLICATIONS

This application claims priority to U.S. Provisional Application No. 60/869,939, filed on Dec. 14, 2006, which is incorporated herein by reference.

FIELD OF THE INVENTION

The present invention relates generally to personal flotation devices and life jackets. More particularly, the present invention relates to personal flotation devices for infants.

BACKGROUND OF THE INVENTION

Water sport and leisure activities are as popular as ever with the safe practice of these activities being at the forefront of every parent's mind. Parents wishing to take their infant children on aquatic activities have had to rely on cumbersome and ill-fitting personal flotation devices (PFDs) for quite some time. The problem is particularly felt for infants weighing less than 25 lbs. A further explanation of this problem will be discussed in relation to currently available PFD's.

U.S. Pat. No. 5,855,497 (French) illustrates an example of the configuration, or style, of a typical life jacket. The primary difference between a life jacket and a personal flotation device (PFD) are the safety standards which apply to them, but both can be considered personal marine buoyant devices to keep a wearer floating in water. These personal marine buoyant devices can be used in recreational, commercial and military applications. Most personal marine buoyant devices, simply referred to as PFD's from this point forward, have the same general configuration shown in FIG. 1.

PFD 10 of FIG. 1 is a vest-style PFD having a front float 12 and a back float 14. The front float 12 and the back float 14 are constructed of a buoyant material, which can either be a single unitary piece of material, or layers of buoyant material enclosed in a shell material, such as nylon for example. The front float 12 is segmented to allow a user to don PFD 10 like a jacket. A strap 16 is attached to the front float 12 to tightly secure the front float 12 and the back float 14 tightly around the torso of a user. While not shown, a zipper can be included for securing the two segments of the front float 12 to each other for a more secure fit. PFD 10 is but one example of the configuration of most PFD's currently available, but those skilled in the art will understand that many available PFD's have the same general configuration as PFD 10. Regardless of the style or configuration, the importance of a secure fit of any PFD is paramount.

The purpose of wearing a PFD or life jacket is to ensure that a wearer falling in water will float in a supinating position i.e., face up. For well-fitting PFDs and life jackets, the wearer entering the water should automatically find himself turned on his back with his face out of the water. A PFD which is not properly secured to the torso of the user, and/or is too large for the user, can result in the PFD slipping off the user. Some PFDs available for small children usually target the 20-30 lbs weight range. When such PFDs are used on even smaller children under 20 lbs, they can be uncomfortable and even dangerous to wear. When a vest-style PFD is used on an infant and is ill fitting, the infant can find himself cradled by the vest in either a pronating or supinating position with his/her face in or barely above the water. Unbeknownst to the parents, the infant child they think is protected by wearing the vest is not safe at all.

This is mainly due to the fact that the typical vest-style PFD such as PFD of FIG. 1, has a front float which is segmented. Each of the two segments, when secured together by a zipper or a strap, will generally conform to the torso of the infant, such that they form a "V". This is illustrated by example in FIG. 2, which shows a cross section of a typical PFD 10, when the infant wearing PFD 10 has fallen face-first into a body of water.

When the PFD 10 is secured to a torso of an infant designated by reference number 18, the segments of front float 12 torso form a "V" shape. Due to the "V" shape and the weight of the infant, the PFD is biased to remain in this position. In other words, the infant will remain face-first in the water 20. Since small infants are not capable of repositioning themselves face-up in the water, there is a high potential of drowning.

In addition to not being safe, an infant wearing such a life vest will be uncomfortable and limited in his movements. Typically, the front of the PFD is too long for the infant. This leads to the front torso portion of the vest partly covering the face the infant when the infant is sitting. This can be remedied by partly unzipping the vest; however, by doing so, the relative safety of the PFD is decreased as the infant can slip out from the PFD.

Infant PFD's are available, as demonstrated by U.S. Pat. No. 6,582,266. FIG. 3 is an illustration of the infant PFD shown in U.S. Pat. No. 6,582,266. This infant PFD 22 is of unitary construction having a front float 24 which is designed to conform to the torso of an infant. The strap 28 which encircles the front float 24 ensures that the front float 24 conforms to the torso of the infant. Because the front float 24 conforms to the torso of infant, the same problem with PFD 10 of FIG. 1 can occur if the infant falls face-first into a body of water. When secured to the infant, the rounded shape of front float 24 will have the same effect as the "V" shaped PFD of PFD 10 shown in FIG. 2. Once again, there is a danger that an infant incapable of righting themselves face-up can drown due to the front-first biasing in the water caused by the shape of the PFD when secured to the torso of the infant.

It is, therefore, desirable to provide a safe PFD for infants. It is also desirable to provide a PFD for infants that will ensure that an infant wearer entering water automatically assumes a supinating position regardless of the way the infant enters the water. It is also desirable to provide a PFD for infants that is comfortable to wear and allows normal movements for an infant wearer.

SUMMARY OF THE INVENTION

It is an object of the present invention to obviate or mitigate at least one disadvantage of previous children PFDs. In particular, it is an object of the present invention to provide a PFD which biases a user face-up in the water by having only a torso float secured to the front of the user's torso. A head float positioned behind the user's head keeps the user's head above water.

In a first aspect, the present invention provides an infant personal flotation device. The infant personal flotation device includes a torso float, a head float and a harness. The torso float is constructed of a rigid and planar buoyant material. The head float is constructed of buoyant material and releasably connectable to a front surface of the torso float. The harness is coupled to a back surface of the torso float and to the head float. In an embodiment of the present aspect, the head float includes a continuous head float strap having first and second end portions connected to the head float, the first and second end portions being spaced apart by a first distance. Connectors can be attached to the first and second end portions for mating with complementary connectors.

According to further embodiments of the present aspect, the head float includes two side segments connected to a center segment in a hinged relationship, the first end portion being connected to one of the two side segments and the second end portion being connected to the other of the two side segments. The torso float includes a first torso float strap connected to the front surface of the torso float, and a second torso float strap connected to the front surface of the torso float. The first torso float strap and the second torso float strap are spaced apart by a second distance smaller than the first distance, and the complementary connectors are attached to the first torso float strap and the second torso float strap.

In yet a further embodiment of the present aspect, the harness includes an adjustable spine strap having one end connected to the torso float and another end connected to the head float. The adjustable spine strap is disposed within a sleeve of the harness, and the harness can include an adjustable waist strap having both ends connected to the torso float. The adjustable waist strap can be disposed within a sleeve of the harness, and can be adjustably sized to define a substantially circular shape having a maximum radius. The torso float, which can be bell-shaped, is bisectable lengthwise by an axis, where a perpendicular distance from the axis to an end of the torso float is greater than said maximum radius.

In a second aspect, the present invention provides an infant personal flotation device. The infant personal flotation device includes a head float, a continuous head float strap, connectors, a torso float, a first torso float strap, a second torso float strap and a harness. The head float is constructed of buoyant material. The continuous head float strap has a first end portion connected to the head float, and a second end portion connected to the head float, the first end portion and the second end portion being spaced apart by a first distance. Connectors are attached to the first end portion and the second end portion for mating with complementary connectors. The torso float is constructed of a buoyant material. The first torso float strap is connected to a front surface of the torso float. The second torso float strap is connected to a front surface of the torso float. The first torso float strap and the second torso float strap are spaced apart by a second distance smaller than the first distance, and the complementary connectors are attached to the first torso float strap and the second torso float strap. The harness is coupled to a back surface of the torso float and to the head float.

According to embodiments of the present aspect, the head float includes two side segments connected to a center segment in a hinged relationship. The first end portion of the continuous head float strap is connected to one of the two side segments and the second end portion of the continuous head float strap is connected to the other of the two side segments. Alternately, the head float includes at least two segments connected in a hinged relationship. The first end portion of the continuous head float strap is connected to one of the at least two side segments and the second end portion of the continuous head float strap is connected to the other of the at least two side segments.

In further embodiments, the torso float is rigid and planar in shape, and the harness includes an adjustable spine strap having one end connected to the torso float and another end connected to the head float. The adjustable spine strap is disposed within a sleeve of the harness, and the harness includes an adjustable waist strap having both ends connected to the torso float. The adjustable waist strap is disposed within a sleeve of the harness, and can be adjustably sized to define a substantially circular shape having a maximum radius. The torso float is bisectable lengthwise by an axis, where a perpendicular distance from the axis to an end of the torso float is greater than said maximum radius.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides an infant PFD having a head float, a torso float and a harness. The infant PFD is configured such that an infant falling in water will automatically assume a supinating position (face-up) regardless of the position the infant had when he entered the water. In otherwords, the infant will float in the water on their backs such that their head and face remains suspended above the water.

Figure 4:
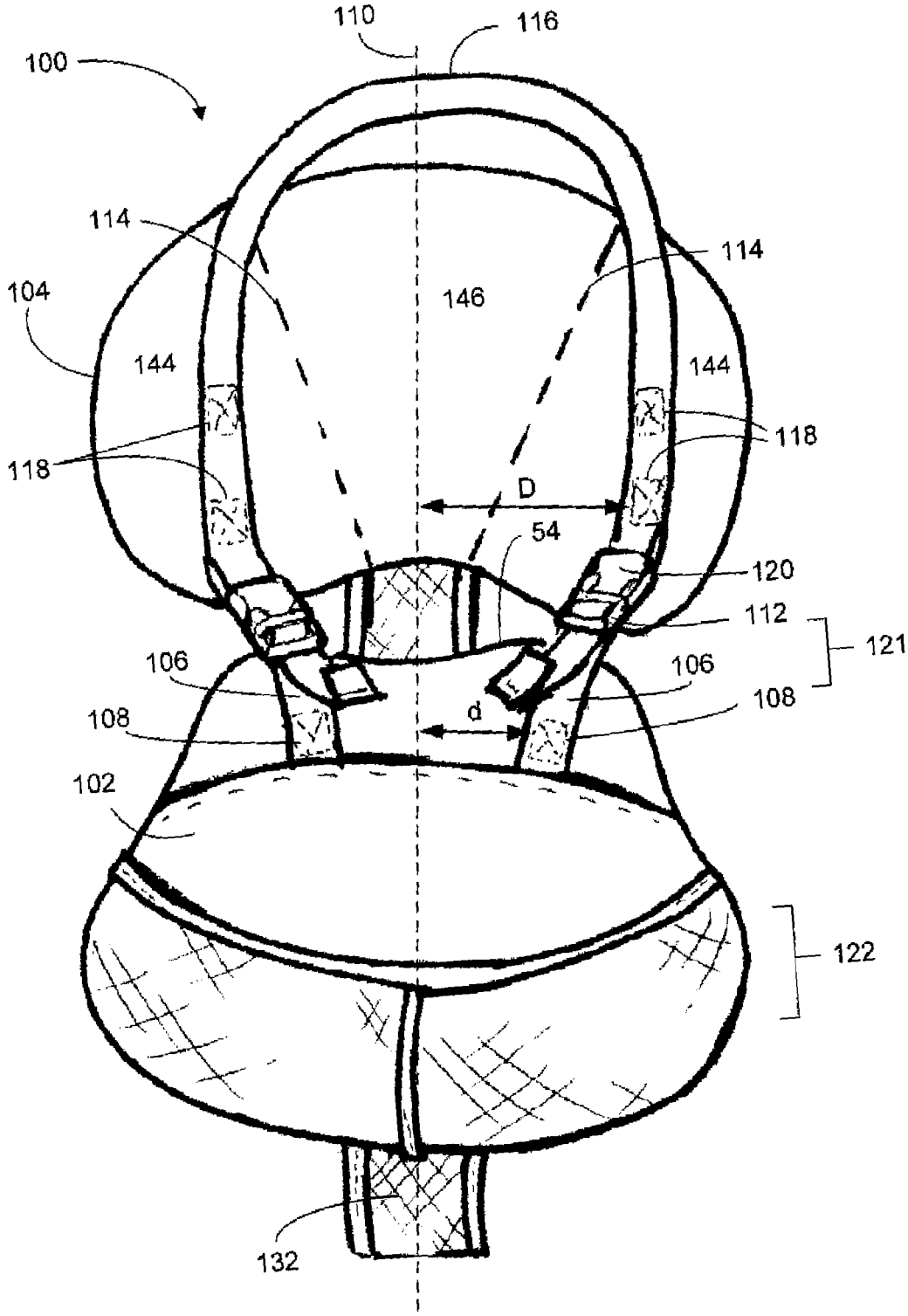
FIG. 4 is a front view of an embodiment of the infant PFD, according to an embodiment of the present invention.

FIG. 4 shows an embodiment of the present invention where a front view of infant PFD 100 is shown. Infant PFD 100 includes a torso float 102 and a head float 104. The torso float 102 shown in FIG. 1 includes a buoyant material (not shown) disposed in a fabric envelope or shell. The torso float 102 is non-conforming, i.e., is relatively rigid and planar such that it does not conform to the shape of the infant's torso. Because the torso float 102 is intended not to conform to the infant's torso, any mass upon it will destabilize the torso float 102 in the water. More specifically, the torso float 102 will be biased to float on the surface of the water when a mass, such as a child's body, rests upon it. It is this principle which will keep the infant face up in the water.

Furthermore, according to a preferred embodiment, the torso float 102 is bell shaped, where the upper portion proximate to the infant's head is narrower than at the bottom portion. Preferably, the bottom portion of torso float 102 has a width dimension that is greater than the width of the infant's torso. Because there is no float element disposed on the back of the infant's torso, the torso float 102 is inherently destabilized in water by the weight of the infant upon it. This destabilization forces torso float 102 to rotate the torso of the infant such that the torso float 102 floats on the surface of the water, which is a stable state. The narrow top portion of torso float 102 does not restrict the infant's arm movements. Any suitable buoyant material can be used. In cases where vinyl coated foam is used as the buoyant material, it is possible to forgo the fabric envelope.

Attached to the front surface of torso float 102 are torso float straps 106, each having one end fixedly secured to the torso float 102 through any suitable means such as, but not limited to, stitches at stitch areas 108. The first and second torso float straps 106 can be, with respect to lengthwise bisecting axis 110, symmetrically disposed on the front of torso float 102. Since the PFD 100 is designed to retain an infant symmetrically about axis 110, the infant's torso 160 will always be centered with respect to the width dimension of torso float 102. The other end of each torso float strap 106 is coupled to a connector 112. The connectors 112 can be adjustably secured to the torso float straps 106 by loops and friction. Connectors 112 are well known in the art, and are in use in many different applications. In the present example, connector 112 can be a male connector. The torso float straps 106 can include a safety securing mechanism in the form a fold at the end of the torso float strap 106. Such a fold prevents the connector 112 from being accidentally disconnected from the torso float strap 106.

The head float 104 shown in FIG. 4 includes a buoyant material (not shown) disposed in a fabric envelope or shell. The head float 104 can include folds 114 for allowing the head float 104 to cradle the head of an infant floating in the water. Further details of this cradling feature will be discussed later. As shown in FIG. 4, the two folds 114 effectively divide the head float 104 into three sections. The folds 114 serve to define compartments in the fabric envelope with each compartment including a buoyant material. The folds can be produced by pinching the material along the dashed line illustrating the fold lines 114, by sewing the front and the back envelope material to each other without intervening buoyant material in between, for example. In contrast to the unitary planar buoyant material of the torso float 102, the sections of head float 104 are intended to conform to and cradle the infant's head. Regardless of the technique for generating the folds, the cradling effect is achieved as long as the two end sections are attached to the middle section in a hinged manner. The cradling of the head of the infant provides stability to the head and prevents water from splashing in the infant's ears and face, thus allowing greater comfort to the infant. Any other suitable means for allowing the head float 104 to cradle the head of the infant can be used. Such means can include, for example, a contoured head float of unitary construction. As for the torso float 102, any suitable buoyant material can be used in the construction of head float 104. In cases where vinyl coated foam is used as the buoyant material, it is possible to forgo the fabric envelope 26.

While the presently described embodiment uses folds to facilitate the hinged motion of the two end sections of the head float 104 with respect to the center section, those skilled in the art will understand that folds 114 are not necessarily required. Any suitable buoyant material which will bend or fold can be used.

Figure 1:
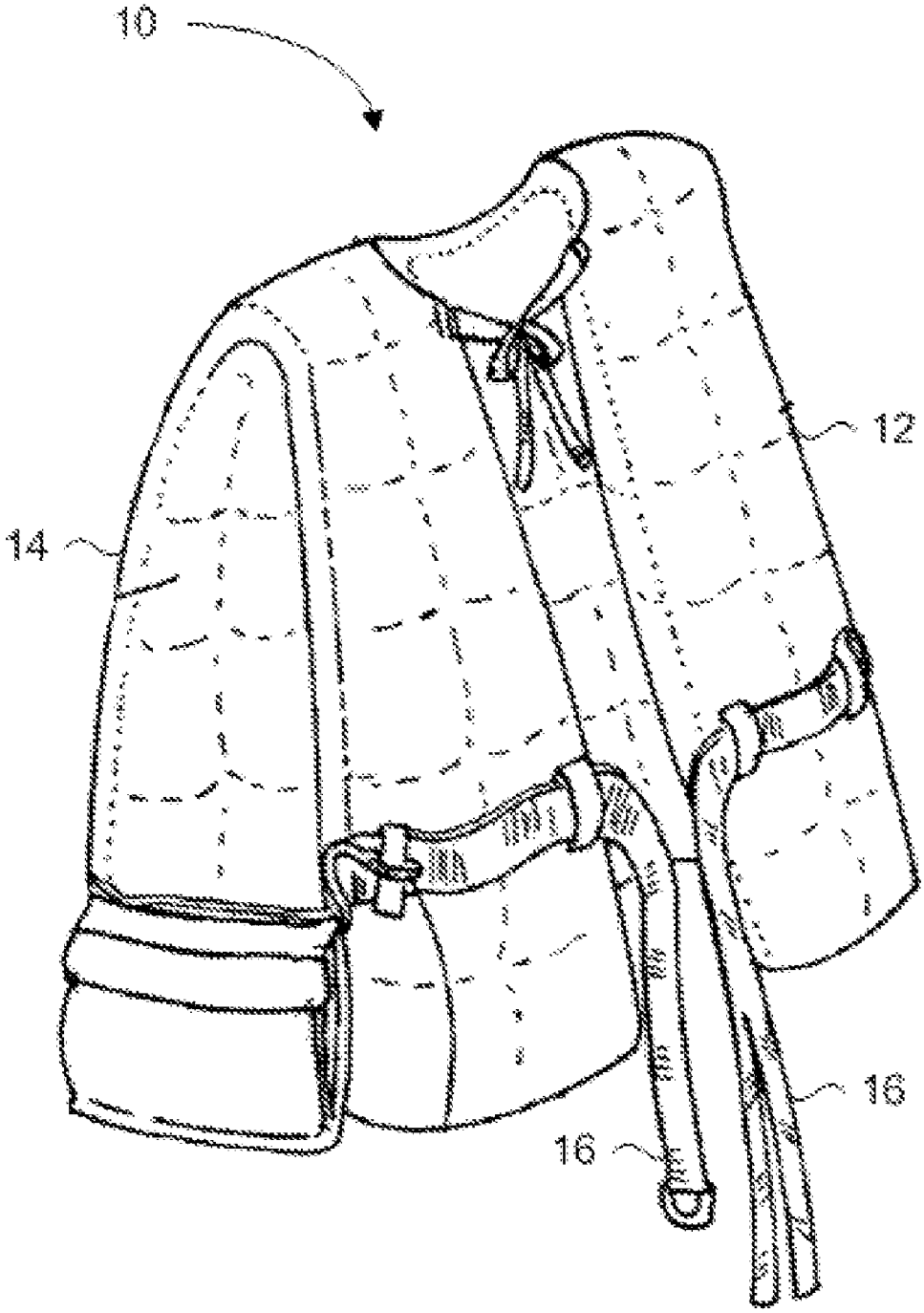
Figure 1 (Prior Art)
FIG. 1 is an illustration of a PFD of the prior art.
Figure 2:
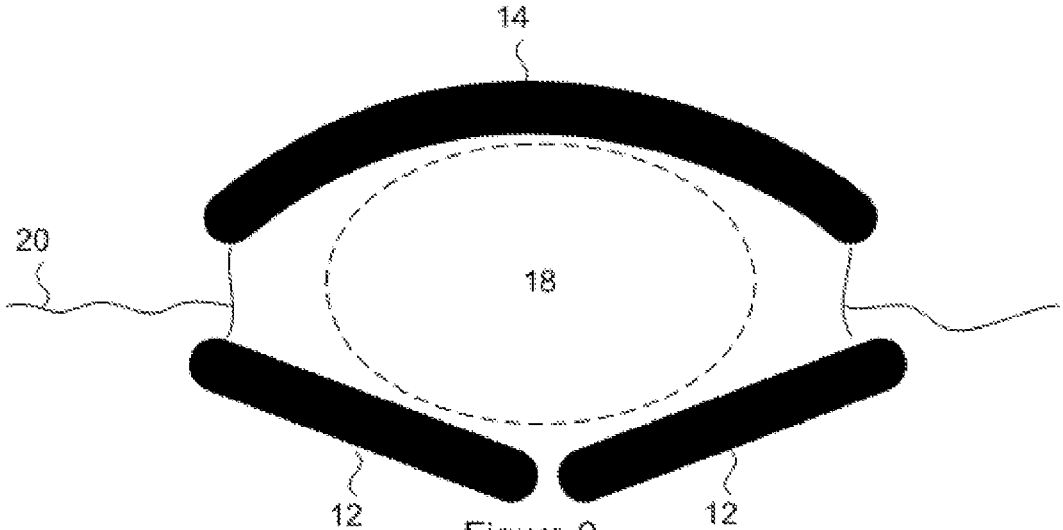
Figure 2 (Prior Art)
FIG. 2 is an illustration of the PFD of FIG. 1 in water.

Attached to the head float 104 is a continuous head float strap 116, which can be fixedly secured to the head float 104 through stitch areas 118. More specifically, the head float strap 116 has two end portions, each of which is secured to the end sections of head float 104. Although four such stitch areas 118 are shown in FIG. 1, any number can be used. Any other suitable means for securing the head float strap 116 to the head float 104 can be used. The head float strap 116 can be symmetrically secured to the head float 104, with respect to a longitudinal axis 110 of the PFD 100.

A preferred feature of head float 104 is the location of the stitch areas 118 relative to the location of stitch areas 108 of torso float straps 106. Using axis 110 as a reference, and assuming that axis 110 is disposed along a vertical center line of PFD 100, stitch areas 118 are disposed further away from axis 110 than stitch areas 108. In particular, using axis 110 as a reference, stitch areas 118 are positioned at a perpendicular distance "D" from axis 110, while stitch areas 118 are positioned at a perpendicular distance "d" from axis 110, where "D">"d".

The free non-secured ends of the head float strap 116 are fixedly secured to connectors 120 through any suitable means such as, but not limited to, folded loops. The connectors 112 and 120 are complementary in shape and allow for releasably securing of the torso float 102 and the head float 104. In the present example, connectors 112 are female connectors. Such connectors 112 and 120 can be implemented with releasable side buckles supplied by ITW Nexus of Des Plaines Ill.

As previously mentioned, the torso float 102 is bell shaped. A further discussion of this feature follows. The torso float 102 is shown as having a taper widening from the neck region 121 to the leg region 122. This taper allows free arm movement for the infant. Additionally, the length between the neck region 121 and the leg region 122 is relatively short in comparison with standard PFD's, such that it allows the infant to sit comfortably without having the torso float 102 impeding movement of the head and legs.

The width of the torso float 102 at the leg region is wider than an infant's torso. Generally, the overall width of torso float 102 is determined to be greater than the torso width of the average 20-pound infant. Naturally, large sized 20 pound infants may need to resort to a different type of PFD, such as those for small children greater than 20 pounds. As discussed below, this allows for greater buoyancy of the infant PFD 100 and also provides for rapid repositioning of an infant from a pronating to a supinating position.

Tests have shown that an infant properly wearing the infant PFD 100 will always end up in a supinating position regardless of the way he/she entered the water. In particular, tests have shown that infants falling in the water in a pronating position are immediately turned on their back to assume a supinating position. This is due to many factors including the relative rigidity of the planar torso float 102 and the width of the torso float 102 at the leg region 122. The relative rigidity of the torso float 102 ensures that the infant is not cradled by the torso float 102. Additionally, having the infant in a pronating position pushing down on the torso float 102 is akin to pushing down a flutter board in the water with a fist: the flutter board's instability inevitably leads to its ascension to the water surface. The width of the torso float 102 at the leg region 122 allows for a greater instability when the infant is in a pronating position in the water and thus allows for rapid repositioning to a supinating position.

As will be understood by a worker skilled in the art, the connector 120 could be adjustable instead of, or in addition to, connector 112.

Figure 5:
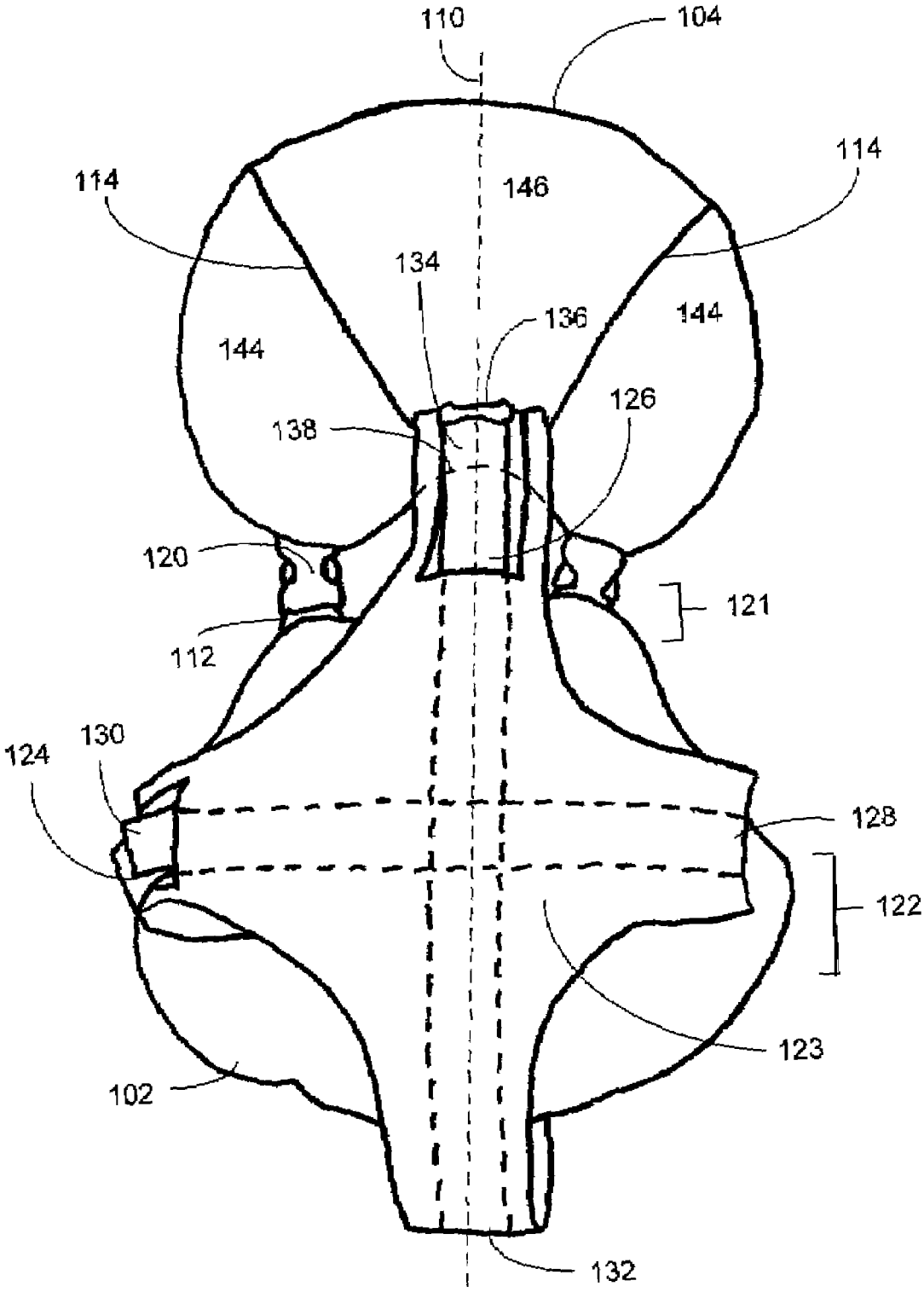
FIG. 5 is a rear view of the infant PFD of FIG. 4.

FIG. 5 shows a rear view of the infant PFD 100. The torso float 102 is shown releasably connected to the head float 104 through mated complementary connectors 112 and 120. Also shown is a harness 123 for securing an infant to the infant PFD 100. Generally, the harness 123 is connected to the back surface of torso float 102 and head float 104. The harness 123 includes a harness waist strap 124 and a harness spine strap 126. The harness waist strap 124 can be adjustably and fixedly attached to the torso float 102. The harness waist strap 124 includes an end portion 128 fixedly secured to the torso float 102 through any suitable means, including, but not limited to, stitches (not shown). The other end portion 130 of the harness waist strap 124 can be adjustably secured to the torso float 100 through any suitable means such as, for example, an adjustment buckle (not shown). In this case, the end portion 130 of the harness waist strap 124 is laced in the adjustment buckle, which can be fixedly secured to the torso float 102 by any suitable means. The end portion 130 of the harness waist strap 124 can include a safety securing mechanism in the form of a fold for preventing the end portion 130 from accidentally disconnecting from the adjustment buckle.

The end portions 128 and 130 of the harness waist strap 124 can be attached to the torso float 102 symmetrically with respect to the longitudinal axis 110. The distance separating the end portions 128 and 130 attached to the torso float 102 can be substantially the same as the width of an infant's torso, while the width of the torso float 102 at the height of the attachment of the end portions 128 and 130 to the torso float 102 can be larger.

The harness spine strap 126 can be adjustably and fixedly attached to the torso float 102 and to the head float 104. The harness spine strap 126 includes an end portion 132 fixedly secured to the bottom region of the torso float 102 through any suitable means such as, for example, stitching (not shown). The opposite end portion 134 of the harness spine strap 126 can be adjustably secured to the head float 104 through any suitable means such as, for example, an adjustment buckle (not shown). In this case, the end portion 134 of the harness spine strap 126 is laced in the adjustment buckle, which can be fixedly secured to the head float 104 by any suitable means. An example of adjustment buckles that can be used in embodiments of the present invention are the Ladderloc™ buckles supplied by ITW Nexus of Des Plaines Ill. The end portion 134 of the harness spine strap 126 can include a safety securing mechanism in the form of a fold for preventing the end portion 134 from accidentally disconnecting from the adjustment buckle.

Figure 3:
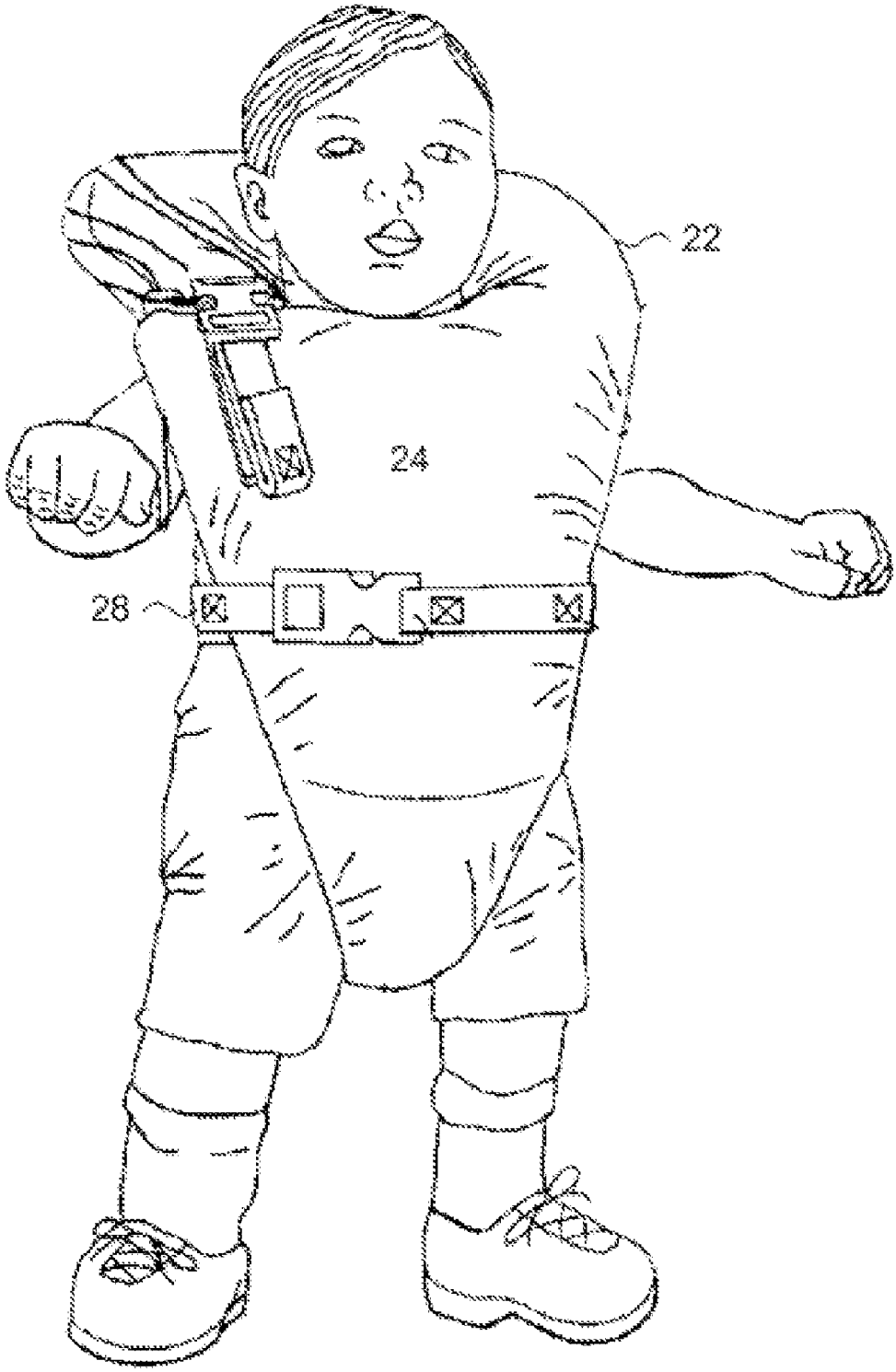
Figure 3 (Prior Art)
FIG. 3 is an illustration of an infant PFD of the prior art.

The adjustment buckle (not shown) for connecting the end portion 134 of the harness spine strap 126 to the head float 104 can be fixedly secured to the head float 104 at the back of the head float 104 at a position 136 of the head float 104. Preferably, position 136 is distant from the lower perimeter of the head float 104, the lower perimeter represented by the dotted line at reference numeral 138 in FIG. 3.

The harness waist strap 124 and the harness spine strap 126 are shown disposed in a mesh sleeve, which is shown fixedly secured to the torso float 102 and to the head float 104. The mesh sleeve helps prevent entanglement of the harness waist strap 124 and the harness spine strap 126 with each other, and also prevents the catching of these straps with surrounding objects as the infant is moved about. This can facilitate the movements of a sitting infant wearing the infant PFD 100. The mesh sleeve also facilitates the placement of an infant in the infant PFD 100 by keeping the harness waist strap 124 and the harness spine strap 126 in a cruciform geometry. Additionally, the mesh sleeve allows for air flow and for quick drying of the harness waist strap 124 and the harness spine strap 126. Those skilled in the art will appreciate that the mesh sleeve can be a simple shell material, such as nylon, instead.

As will be understood by a worker skilled in art, the placement of a harness waist strap adjustment buckle with respect to the left or right side of the infant PFD 100 and the placement of a harness spine strap adjustment buckle with respect to the top or bottom of the infant PFD 100 is not relevant to the present invention.

Following is a description of how the PFD 100 of the present invention is worn by an infant. To place an infant in the infant PFD 100, the connectors 112 and 120 are released and the infant is placed in the harness 123 with one leg on each side of the harness spine strap 126. The connectors 112 and 120 are then redone and the harness spine strap 126, the harness waist strap 124 and the torso float straps 106 are adjusted to securely and comfortably secure the infant PFD 100 to the infant. The infant wearing the infant PFD 100 has the torso float adjacent his front torso and head float 104 behind the head. Therefore while in water, the head of the infant floats upon head float 104, while the torso float 102 "pulls" the body of the infant to just below the water surface via the harness.

As previously mentioned, head float 104 provides a cradling feature for the infant's head. This is due to the position of the stitch areas on head float 104 for head float strap 116 relative to the position of the stitch areas on torso float 102, and the segmentation of head float 104 into two side segments 144 and a center segment 146. As shown in FIG. 4, the distance "D" between axis 110 and stitch areas 118 on the head float 104 is larger that the distance "d" between axis 110 and stitch areas 108 of the torso float 102. This results in further cradling of the infant's head when the head float strap 116 is pulled, either in emergency situations or in play activities, in a direction away from the torso float 102.

Those skilled in the art will appreciate that the head float 104 is not limited to three segments, and can be implemented with any number of segments, or alternatively with no segments, provided that the material is sufficiently compliant. In such a configuration, where the head float 104 has least two segments connected in a hinged relationship, the first end portion of the continuous head float strap would be connected to one of the at least two side segments and the second end portion of the continuous head float strap would be connected to the other of the at least two side segments.

Figure 6A:
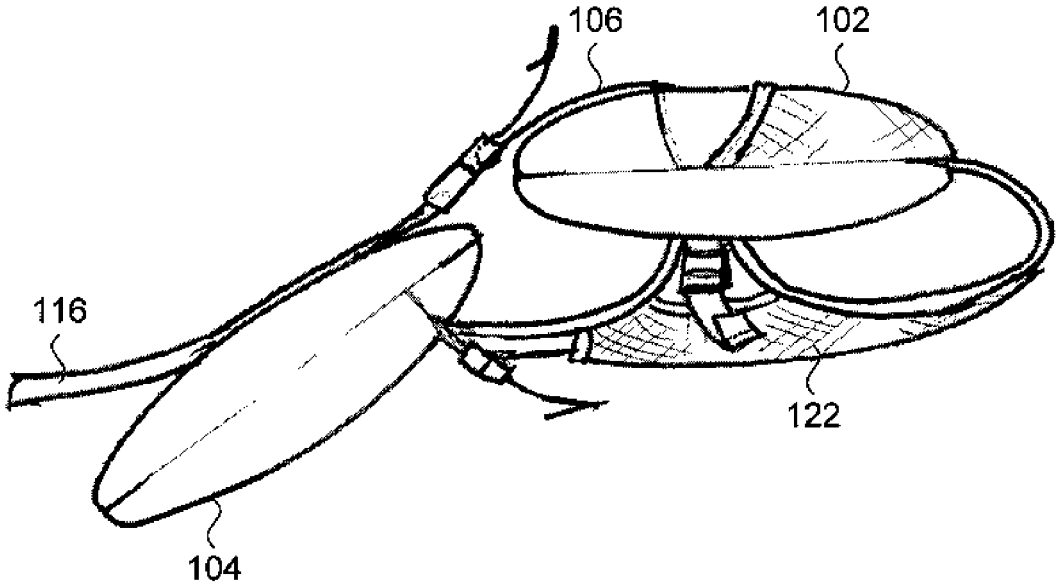
FIG. 6*a* is a side view of the infant PFD of FIG. 4 in a relaxed position.
Figure 6B:
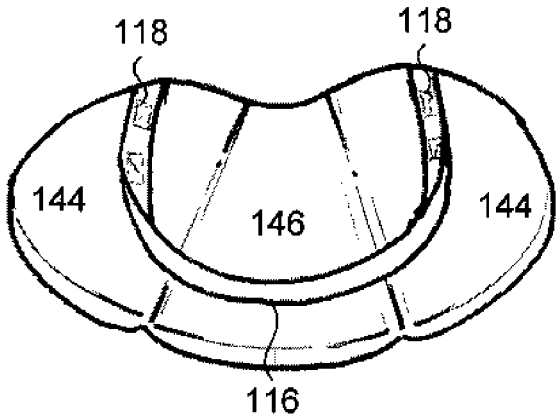
FIG. 6*b* is a front end view of the infant PFD of FIG. 4 in the relaxed position.

The cradling effect provided by PFD 100 according to the embodiments of the present invention will now be described with reference to FIGS. 6*a*, 6*b*, 7*a* and 7*b*. FIG. 6*a* is a side view of the infant PFD 100 according to an embodiment of the present invention, shown in a relaxed, or natural position. FIG. 6*b* is a front end view of the PFD of FIG. 6*a*, showing in particular head float 104, in the relaxed position. In the natural position, the head float strap 116 has not been pulled tight. Therefore, the head float 104 and in particular the segments 144 and 146 take on a substantially planar configuration.

Figure 7A:
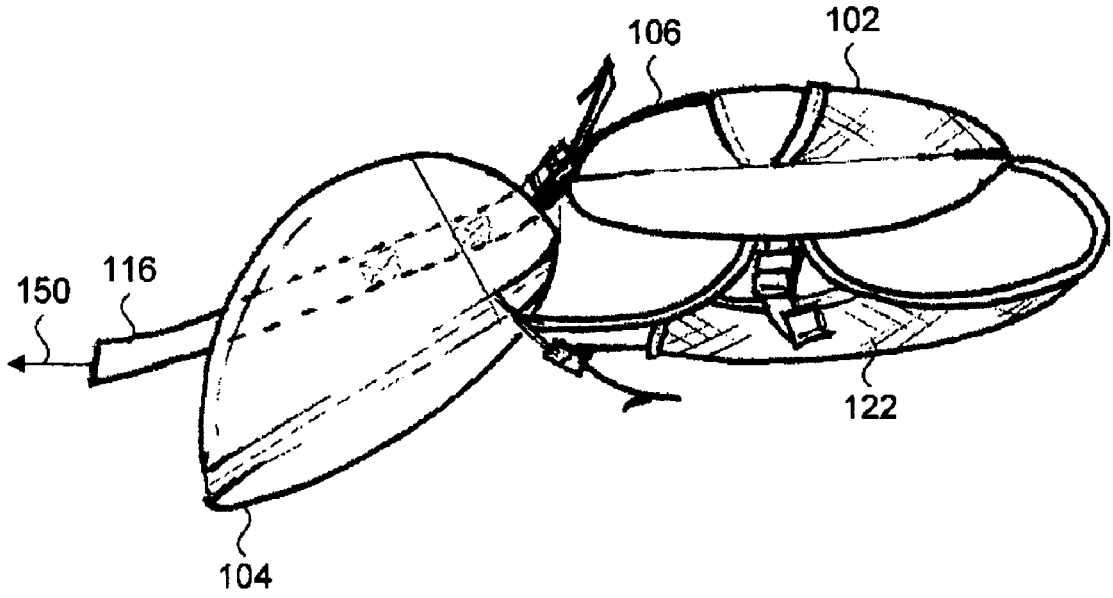
FIG. 7*a* is a side view of the infant PFD of FIG. 4 in a head cradling position.
Figure 7B:
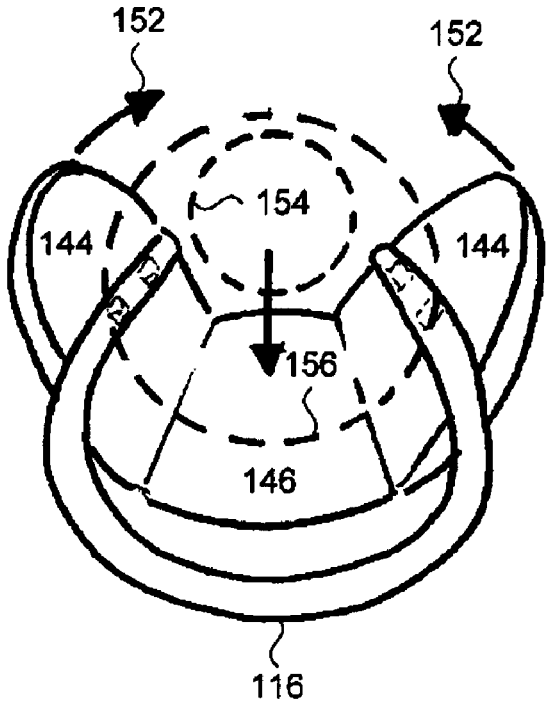
FIG. 7*b* is a front end view of the infant PFD of FIG. 4 in the head cradling position.

FIG. 7*a* is a side view of the PFD 100 of FIG. 6*a* once head float strap 116 has been pulled away from torso float 102, in the direction indicated by arrow 150. In this case, the side segments 144 of the head float 104 raise and the central segment 146 lowers thereby stabilizing the infant's head. FIG. 7*b* is a front end view of FIG. 6*b* when head float strap 116 has been pulled away from torso float 102. Arrows 152 pointing to each other in FIG. 6*b* show the directional bias of the head float segments connected to the strap, when the strap is pulled.

When the head float strap 116 has been pulled tight (due to loading provided by the inertia of the infant wearing the PFD), the segments 144 connected to the head float strap 116 are biased towards each other, and the center segment 146 moves away from the baby's head. A cavity is thereby created to cradle the baby's neck and head. Note the dashed circles in FIG. 7*b*, where the smaller circle 154 indicates where a baby's neck would be in relation to the head float 104, and the larger circle 156 indicates where a baby's head would be in relation to head float 104. Because torso float straps 106 are secured closer together on the torso float 102 than the end portions of head float strap 116, head float strap 116 will have a tendency to become coincidentally parallel to torso float straps 106.

Figure 8A:
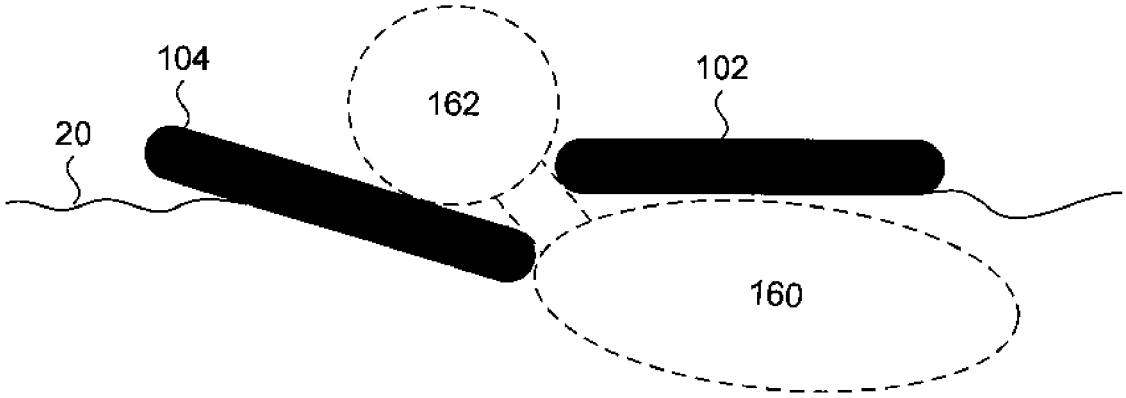
FIG. 8*a* is a side view of the infant PFD in use.

FIG. 8*a* is a side view illustration showing PFD 100 of the present invention in use. While in water 20, torso float 102 will keep the infant's torso 160 in the supinating position. The harness and straps are not shown to simplify the illustration. The head float 104 will keep the infant's head 162 above water, thus maximizing safety of the infant in water.

Figure 8B:
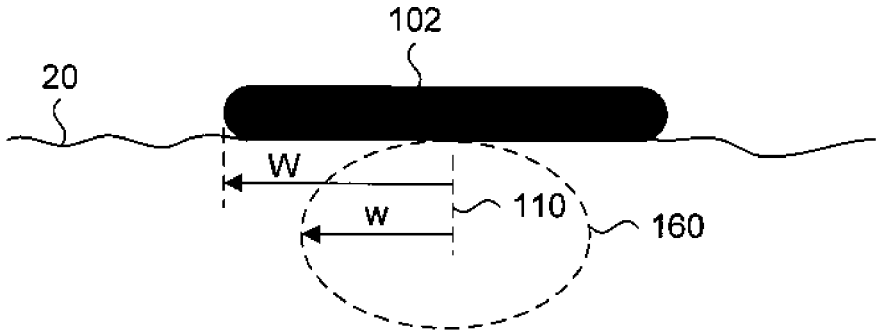
FIG. 8*b* is a bottom end view of the infant PFD of FIG. 8*a*.

FIG. 8*b* is a bottom end view of the PFD shown in FIG. 8*a*. Since the width of torso float 102 is greater than the infant's torso 160, PFD 100 will be stabilized in this position in the water, thereby minimizing the probability of the infant rolling over to the pronating position (ie. face-down).

FIG. 8*b* further illustrates the relative dimensions of the torso float width and the infant torso width. Central axis 110 is once again used as a reference point to show that the half width of the torso float 102, labeled "W" is greater than the half width of the infant, labeled "w". As previously discussed, the infant's torso 160 will be centered with respect to the width dimension of torso float 102. Since infants can be shaped differently, harness 123 and in particular harness waist strap 124, can be sized to accommodate a maximum circular or elliptical circumference which should correspond to the torso shape of an infant. Therefore, only infants having a torso that can fit within harness 123 can use PFD 100 safely, since the harness 123 and harness waist strap 124 can be sized to define a maximum radius (ie. dimension "w") that is less than the half width "W" of torso float 102.

Generally, the present invention provides an infant PFD having a head float, a torso float and a harness. The torso float includes a buoyant non-conforming material that ensures that an infant falling in water will automatically assume a supinating position regardless of the position the infant had when he entered the water.

While the presently described embodiments are directed to PFD's for infants, the PFD embodiments can be modified and configured for adolescents and adults.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An infant personal flotation device comprising:

a torso float constructed of a substantially rigid and substantially planar buoyant material, the torso float having a width;

a head float constructed of buoyant material and releasably connectable to a front surface of the torso float; and, a harness coupled to a back surface of the torso float and to the head float, the harness sized to define a space for placing the infant, the space having a maximum width smaller than the width of the torso float.

2. The infant personal flotation device of claim 1, wherein the head float includes a continuous head float strap having first and second end portions connected to the head float, the first and second end portions being spaced apart by a first distance; and connectors attached to the first and second end portions for mating with complementary connectors.

3. The infant personal flotation device of claim 2, wherein the head float includes two side segments connected to a center segment in a hinged relationship, the first end portion being connected to one of the two side segments and the second end portion being connected to the other of the two side segments.

4. The infant personal flotation device of claim 2, wherein the torso float includes a first torso float strap connected to the front surface of the torso float; and a second torso float strap connected to the front surface of the torso float, the first torso float strap and the second torso float strap being spaced apart by a second distance smaller than the first distance, and the complementary connectors being attached to the first torso float strap and the second torso float strap.

5. The infant personal flotation device of claim 1, wherein the harness includes an adjustable spine strap having one end connected to the torso float and another end connected to the head float.

6. The infant personal flotation device of claim 5, wherein the adjustable spine strap is disposed within a sleeve of the harness.

7. The infant personal flotation device of claim 1, wherein the harness includes an adjustable waist strap having both ends connected to the torso float.

8. The infant personal flotation device of claim 5, wherein the adjustable waist strap is disposed within a sleeve of the harness.

9. The infant personal flotation device of claim 7, wherein the adjustable waist strap is sized to define a substantially circular shape having a maximum radius.

10. The infant personal flotation device of claim 9, wherein the torso float is bisectable lengthwise by an axis, a perpendicular distance from the axis to an end of the torso float being greater than said maximum radius.

11. The infant personal flotation device of claim 10, wherein the torso float is bell-shaped.

12. An infant personal flotation device comprising:

a head float constructed of buoyant material;

a continuous head float strap having a first end portion connected to the head float, and a second end portion connected to the head float, the first end portion and the second end portion being spaced apart by a first distance;

connectors attached to the first end portion and the second end portion for mating with complementary connectors;

a torso float constructed of a buoyant material;

a first torso float strap connected to a front surface of the torso float;

a second torso float strap connected to a front surface of the torso float, the first torso float strap and the second torso float strap being spaced apart by a second distance smaller than the first distance, and the complementary connectors being attached to the first torso float strap and the second torso float strap; and, a harness coupled to a back surface of the torso float and to the head float.

13. The infant personal flotation device of claim 12, wherein the head float includes two side segments connected to a center segment in a hinged relationship, the first end portion of the continuous head float strap being connected to one of the two side segments and the second end portion of the continuous head float strap being connected to the other of the two side segments.

14. The infant personal flotation device of claim 12, wherein the head float includes at least two segments connected in a hinged relationship, the first end portion of the continuous head float strap being connected to one of the at least two side segments and the second end portion of the continuous head float strap being connected to the other of the at least two side segments.

15. The infant personal flotation device of claim 12, wherein the torso float is rigid and planar in shape.

16. The infant personal flotation device of claim 12, wherein the harness includes an adjustable spine strap having one end connected to the torso float and another end connected to the head float.

17. The infant personal flotation device of claim 16, wherein the adjustable spine strap is disposed within a sleeve of the harness.

18. The infant personal flotation device of claim 12, wherein the harness includes an adjustable waist strap having both ends connected to the torso float.

19. The infant personal flotation device of claim 18, wherein the adjustable waist strap is disposed within a sleeve of the harness.

20. The infant personal flotation device of claim 18, wherein the adjustable waist strap is sized to define a substantially circular shape having a maximum radius.

21. The infant personal flotation device of claim 20, wherein the torso float is bisectable lengthwise by an axis, a perpendicular distance from the axis to an end of the torso float being greater than said maximum radius.

22. An infant personal flotation device comprising:

a torso float constructed of a substantially rigid and substantially planar buoyant material, the torso float having a width greater than a width of a torso of an infant;

a head float constructed of buoyant material and releasably connectable to a front surface of the torso float; and, a harness coupled to a back surface of the torso float and to the head float.

23. An infant personal flotation device comprising:

a torso float constructed of a substantially rigid and substantially planar buoyant material, the torso float having a width;

a head float constructed of buoyant material and releasably connectable to a front surface of the torso float; and, an adjustable waist strap coupled to a back surface of the torso float, the adjustable waist strap sized to define a space for placing the infant, the space having a maximum width smaller than the width of the torso float.

* * * * *